US007311548B1

(12) United States Patent
Dunham et al.

(10) Patent No.: US 7,311,548 B1
(45) Date of Patent: Dec. 25, 2007

(54) JUMPER INSTALLATION FEEDBACK

(75) Inventors: Scott N. Dunham, Raleigh, NC (US); William B. Schwartz, Apex, NC (US); Jeffrey B. Williams, Raleigh, NC (US); Edward V. Zorek, Sr., Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/456,494

(22) Filed: Jul. 10, 2006

(51) Int. Cl.
*H01R 31/08* (2006.01)

(52) U.S. Cl. ..... 439/510; 439/490

(58) Field of Classification Search ..... 439/507, 439/510–514, 490
See application file for complete search history.

(56) References Cited

U.S. PATENT DOCUMENTS

| | | | | | |
|---|---|---|---|---|---|
| 4,482,198 | A * | 11/1984 | Crowley | 439/514 |
| 4,516,817 | A * | 5/1985 | Deters | 439/513 |
| 4,631,377 | A * | 12/1986 | Imazeki et al. | 200/313 |
| 4,726,787 | A * | 2/1988 | Stine | 439/510 |
| 4,795,602 | A * | 1/1989 | Pretchel et al. | 264/272.15 |
| 4,855,824 | A * | 8/1989 | Fuhrer | 348/434.1 |
| 5,014,002 | A * | 5/1991 | Wiscombe et al. | 324/537 |
| 5,169,337 | A * | 12/1992 | Ortega et al. | 439/510 |
| 5,201,853 | A * | 4/1993 | Alwine | 439/188 |
| 5,449,301 | A * | 9/1995 | Hanna et al. | 439/510 |
| 5,669,787 | A * | 9/1997 | Miyazawa | 439/510 |
| 5,700,147 | A | 12/1997 | Chung | |
| 5,810,617 | A * | 9/1998 | Hasagawa | 439/510 |
| 5,876,239 | A | 3/1999 | Morin et al. | |
| 5,921,810 | A * | 7/1999 | Murakoshi | 439/510 |
| 6,036,534 | A * | 3/2000 | Hoyt et al. | 439/510 |
| 7,125,280 | B1 * | 10/2006 | Lee et al. | 439/490 |
| 2001/0000767 | A1 * | 5/2001 | Ezawa et al. | 439/490 |
| 2001/0007526 | A1 * | 7/2001 | Ohkohdo et al. | 362/249 |

* cited by examiner

*Primary Examiner*—Ross Gushi
(74) *Attorney, Agent, or Firm*—Sawyer Law Group LLP

(57) ABSTRACT

A jumper including a connecting face, a light-emitting face, and a light pipe extending from the connecting face to the light-emitting face is provided. The light pipe is operable to transmit a light from a provided computer hardware from the connecting face to the light-emitting face responsive to the jumper forming a circuit with the provided computer hardware. A method for fabricating a jumper is also provided. The method includes forming a plurality of receptacles on a connecting face of the jumper and incorporating a light pipe into the jumper such that the light pipe extends from the connecting face of the jumper to a light-emitting face of the jumper. A method for providing jumper installation feedback is further provided. The method includes mounting a jumper on a provided computer hardware and transmitting a light through the jumper responsive to the jumper forming a circuit with the provided computer hardware.

13 Claims, 5 Drawing Sheets

JUMPER INSTALLATION FEEDBACK

FIELD OF THE INVENTION

The present invention relates generally to jumpers. More particularly, the present invention is directed to jumper installation feedback.

BACKGROUND OF THE INVENTION

A jumper is a small metal device that can fit over two or more pins on a piece of computer hardware, such as a printed circuit board (PCB), to short the pins together, thereby completing an electrical circuit. Jumpers are also referred to as microjumpers or jumper shunts. Typically, jumpers are encased in a non-conductive block of plastic for convenience and to prevent accidental shortage. How the pins on the piece of computer hardware are shorted or not shorted together determines the configuration for the piece of computer hardware. For instance, jumpers can be used to set the voltage, speed, etc. of the piece of computer hardware.

When a piece of computer hardware is incorporated into a system, such as a server, a desktop, a workstation, or a laptop, the pins to be shorted together may be located in hard to reach places and/or may be hard to locate due to low lighting conditions within the system. In addition, the internal connection within a jumper may occasionally sever resulting in no electrical contact between the jumper and the pins the jumper is interfacing with.

Further, even when a jumper is properly connected to a set of pins, it is sometimes hard to determine whether it is the correct set of pins for the desired configuration because pins on a piece of computer hardware are usually only identified by a silk screen print on the computer hardware, which may be hard to see. Moreover, when multiple jumpers are connected to a piece of computer hardware, it is sometimes hard to determine which jumper or jumpers correlate to a specific configuration for the computer hardware.

Accordingly, there is a need for a mechanism to provide jumper installation feedback. The present invention addresses such a need.

SUMMARY OF THE INVENTION

A jumper operable to configure computer hardware is provided. The jumper includes a connecting face, a light-emitting face, and a light pipe extending from the connecting face to the light-emitting face. The light pipe is operable to transmit a light from a provided computer hardware from the connecting face of the jumper to the light-emitting face of the jumper in response to the jumper forming a circuit with the provided computer hardware.

A method for fabricating a jumper operable to configure computer hardware is also provided. The method includes forming a plurality of receptacles on a connecting face of the jumper and incorporating a light pipe into the jumper such that the light pipe extends from the connecting face of the jumper to a light-emitting face of the jumper.

A method for providing jumper installation feedback is further provided. The method includes mounting a jumper on a provided computer hardware and transmitting a light from the provided computer hardware through the jumper in response to the jumper forming a circuit with the provided computer hardware.

DETAILED DESCRIPTION

The present invention relates generally to jumpers and more particularly to jumper installation feedback. The following description is presented to enable one of ordinary skill in the art to make and use the invention and is provided in the context of a patent application and its requirements. Various modifications to the implementations and the generic principles and features described herein will be readily apparent to those skilled in the art. Thus, the present invention is not intended to be limited to the implementations shown, but is to be accorded the widest scope consistent with the principles and features described herein.

Jumpers are small metal devices, which are typically encased in non-conductive housing (e.g., plastic), that can be used to configure computer hardware, such as printed circuit boards (PCBs). Computer hardware can be configured by fitting a jumper over two or more pins on a surface of the computer hardware, which then shorts the pins together to complete an electrical circuit. The pins that are shorted together may set, for instance, the voltage or the speed of the computer hardware. Other terms that may be used to refer to jumpers include, for example, microjumpers and jumper shunts.

Installation of a jumper can sometimes be difficult when the computer hardware the jumper is to be installed on has been incorporated into a system (e.g., servers, desktops, workstations, laptops, etc.) due to low lighting conditions and/or hard to reach pin locations. Additionally, there is usually no way to know whether an installed jumper has proper electrical contact with the pins on the computer hardware simply by looking at the installed jumper.

Occasionally, jumpers that were properly installed at one point will need to be replaced because the internal connections within the jumpers have severed. It is typically not possible to identify which jumpers on a piece of computer hardware have failed merely by glancing at the piece of computer hardware.

Further, because pins on computer hardware are generally solely identified by a silk screen print on the computer hardware, which may be difficult to make out, it is sometimes hard to determine whether a jumper has been installed on the correct set of pins for the configuration desired. Moreover, identifying which jumper or jumpers on a piece of computer hardware correlate to a particular configuration becomes problematic as the number of jumpers on the piece of computer hardware increases.

Figure 1:
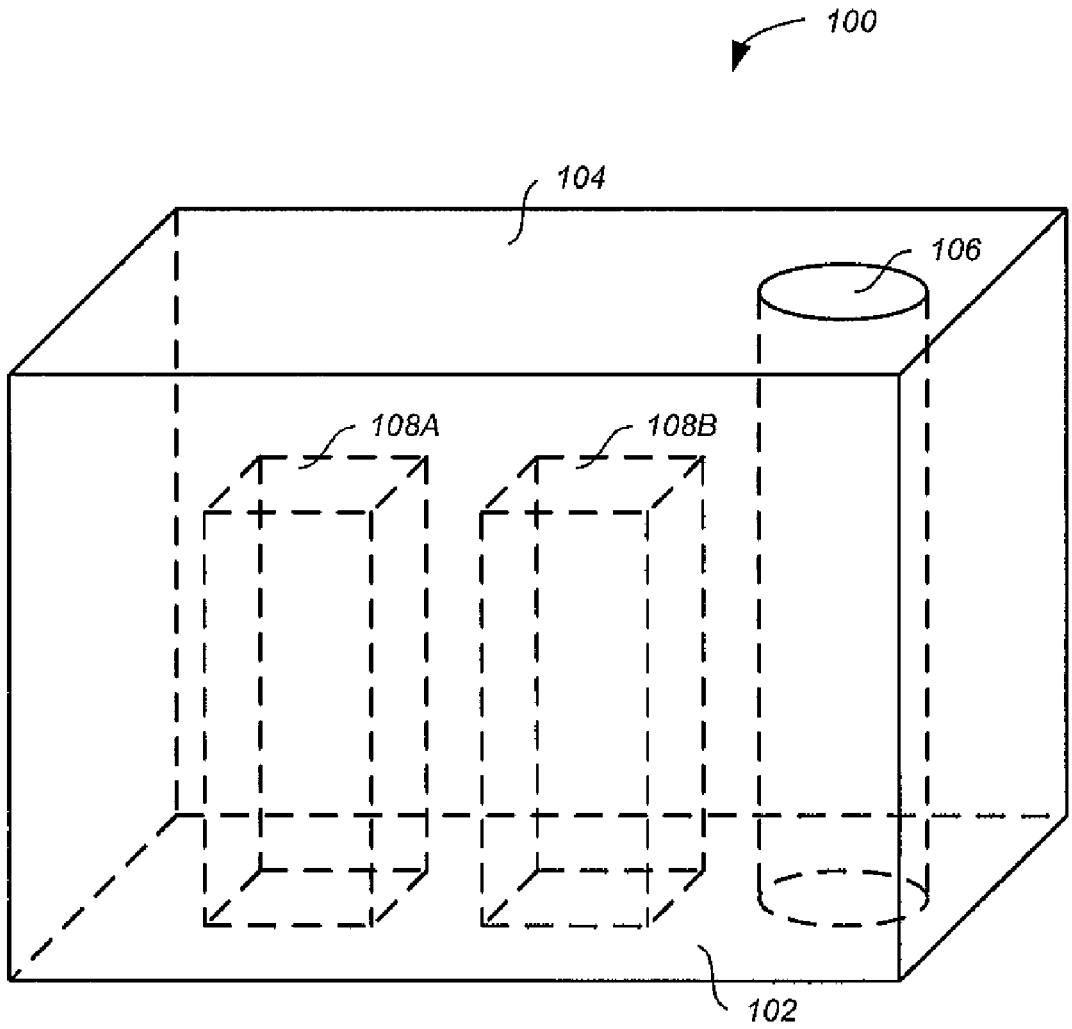
FIGS. 1-2 illustrate jumpers operable to configure computer hardware in accordance with various embodiments of the invention.

Illustrated in FIG. 1 is a jumper 100 operable to configure computer hardware in accordance with an implementation of the invention. Jumper 100 includes a connecting face 102, a light-emitting face 104, and a light pipe 106 extending from connecting face 102 to light-emitting face 104. In the implementation, light pipe 106 is operable to transmit a light from a provided computer hardware (not shown) from connecting face 102 to light-emitting face 104 in response to jumper 100 forming a circuit with the provided computer hardware. Jumper 100 also includes receptacles 108A and 108B that are operable to interface with pins on the provided computer hardware.

For purposes of simplifying the drawing, jumper 100 has been illustrated without certain elements, such as the metal within and connecting receptacles 108A and 108B. In other embodiments, jumper 100 may include additional receptacles and/or light pipes. Further, the arrangement of light pipe 106 and receptacles 108A-108B may be different in other implementations. As an example, light pipe 106 may be located substantially in between receptacles 108A-108B.

The size and shape of jumper 100, light pipe 106, and receptacles 108A-108B may also vary in other embodiments. For instance, light pipe 106 need not be cylindrical in shape and receptacles 108A-108B need not be rectangular in shape. Moreover, connecting face 102 and light-emitting face 104 may be substantially perpendicular rather than substantially parallel in another implementation of the invention. In such an embodiment, light pipe 106 may be slanted or curved in order to extend from connecting face 102 to light-emitting face 104.

By incorporating a light pipe into a jumper, installation feedback can be provided through the illumination of a light source, such as a light-emitting diode (LED), on a surface of a computer hardware when the jumper completes a circuit with pins on the surface of the computer hardware. The light from the computer hardware can then be transmitted through the light pipe of the jumper to indicate to an installer that the jumper is properly connected.

Using a jumper with a light pipe incorporated therein may also allow the installer to determine whether the jumper has been installed on the correct set of pins, for instance, by having different color LEDs on the surface of the computer hardware to denote the different computer hardware configurations. Further, locating a specific jumper may now be as easy as turning on a light source on the surface of the computer hardware that corresponds to the specific jumper. This may be accomplished through a controller that is incorporated into the piece of computer hardware or a controller that is external to the piece of computer hardware.

Figure 2:
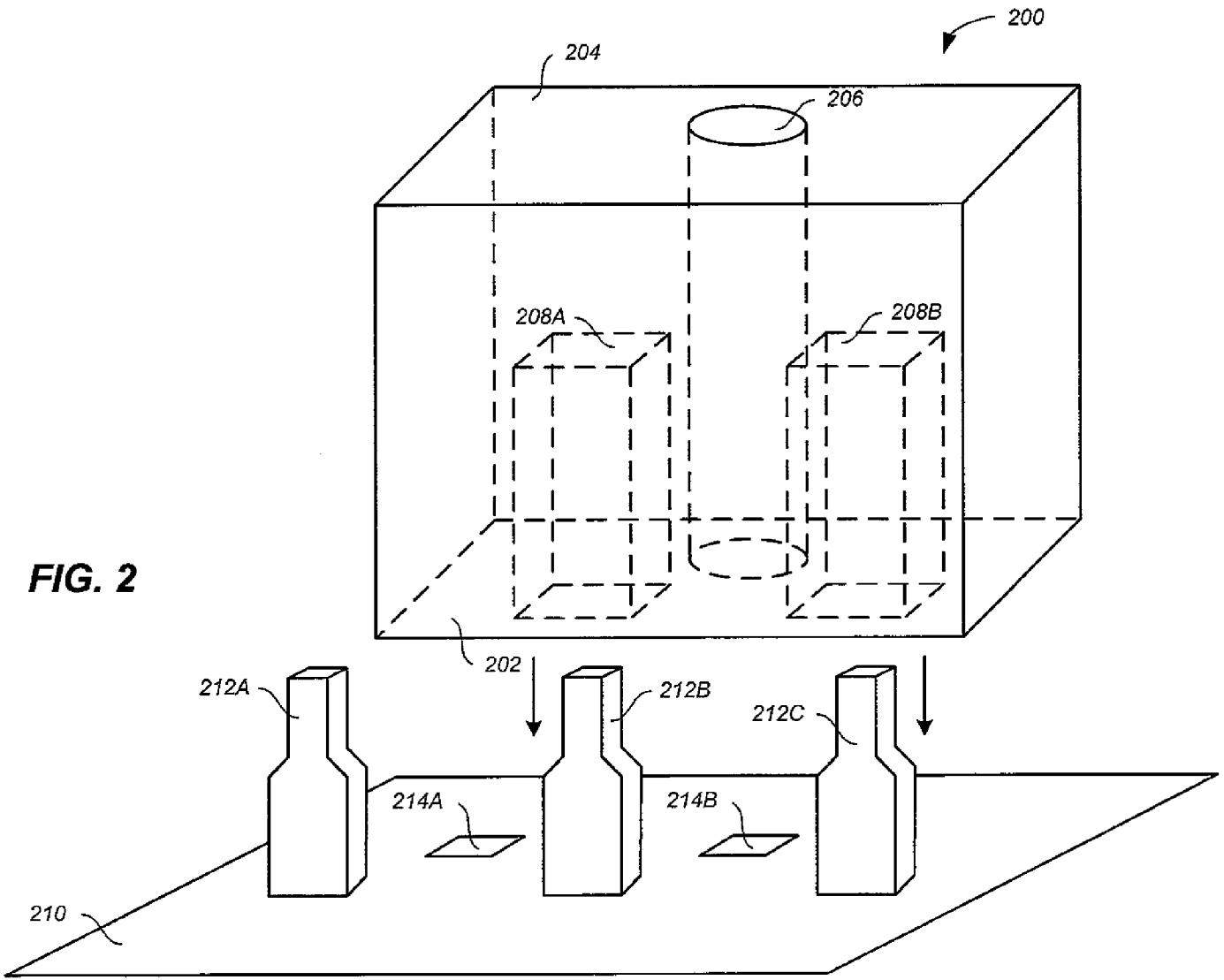

FIG. 2 depicts a jumper 200 operable to configure a computer hardware 210 in accordance with an aspect of the invention. Jumper 200 includes a connecting face 202, a light-emitting face 204, receptacles 208A and 208B, and a light pipe 206 extending from connecting face 202 to light-emitting face 204 and situated substantially between receptacles 208A-208B. As with jumper 100, jumper 200 is depicted without certain elements in order to simplify the drawing.

Computer hardware 210 includes pins 212A-212C and light sources 214A-214B. In one implementation, light sources 214A-214B are LEDs embedded into computer hardware 210. LEDs 214A-214B may be powered by an external power source (not shown) or a power source on computer hardware 210, such as a battery or capacitor. For purposes of simplification, computer hardware 210 has been depicted without particular components, such as integrated circuit (IC) chips, power sources, wires, etc. Other embodiments of computer hardware 210 may include different number and arrangement of pins and light sources.

As seen in FIG. 2, when jumper 200 is properly connected to pins 212B-212C on computer hardware 210, the light from LED 214B will be transmitted through light pipe 206 to serve as feedback to a user installing jumper 200 that an electrical circuit has been formed. In addition, if LEDs 214A and 214B are of different color, then it will be easy for the user to determine which set of pins—212A-212B or 212B-212C—the jumper is mounted on.

In another embodiment, LED 214B may be illuminated prior to insertion of jumper 200 on computer hardware 210 to assist the user in mounting jumper 200; for example, to help the user in identifying pins 212B-212C. Additionally, if light source 214B is illuminated before jumper 200 is mounted, light source 214B may change color when jumper 200 forms a circuit with pins 212B-212C to indicate that a proper connection has been made.

Figure 3:
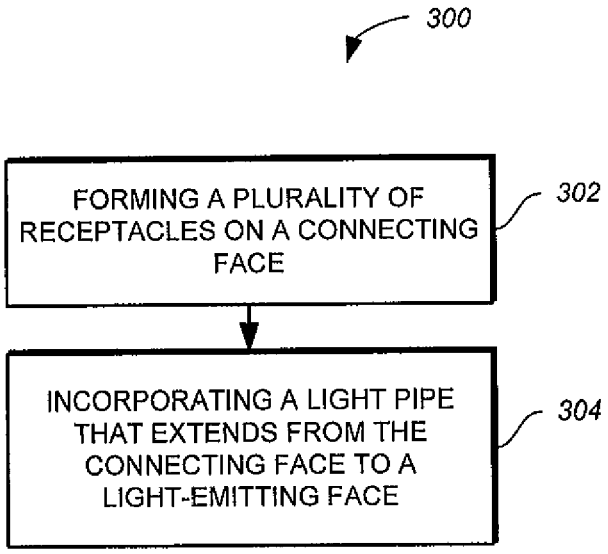
FIG. 3 is a process flow of a method for fabricating a jumper operable to configure computer hardware according to an implementation of the invention.

Shown in FIG. 3 is a process 300 for fabricating a jumper operable to configure computer hardware in accordance with an embodiment of the invention. At 302, a plurality of receptacles are formed on a connecting face of the jumper. A light pipe is incorporated into the jumper at 304. The light pipe extends from the connecting face of the jumper to a light-emitting face of the jumper. The connecting face of the jumper may be substantially perpendicular to the light-emitting face of the jumper (e.g., 45 degrees or more relative to the light-emitting face) or substantially parallel to the light-emitting face of the jumper (e.g., less than 45 degrees relative to the light-emitting face).

In one embodiment, the light pipe is incorporated substantially between two of the plurality of receptacles. In another embodiment, the light pipe is incorporated substantially within a housing of the jumper. The housing of the jumper is a non-conductive portion of the jumper.

The light pipe is operable to transmit a light from a provided computer hardware from the connecting face of the jumper to the light-emitting face of the jumper in response to the jumper forming a circuit with the provided computer hardware in one implementation of the invention. In another implementation, the light pipe is operable to transmit the light in response to the jumper being selected for identification.

In a further implementation of the invention, the plurality of receptacles is operable to interface with a plurality of pins on a provided computer hardware and the light pipe is operable to transmit a light from the provided computer hardware from the connecting face of the jumper to the light-emitting face of the jumper in response to the plurality of receptacles interfacing with a particular subset of the plurality of pins on the provided computer hardware.

Figure 4:
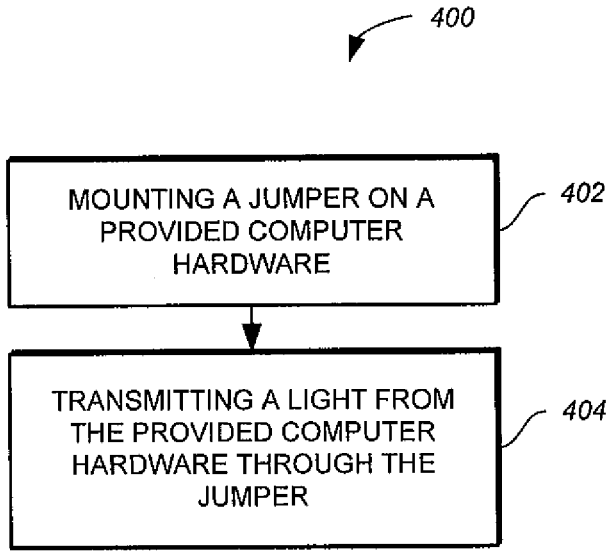
FIG. 4 shows a flow chart of a method for providing jumper installation feedback in accordance with an aspect of the invention.

FIG. 4 is a flow chart of a process 400 for providing jumper installation feedback according to one aspect of the invention. At 402, a jumper is mounted on a provided computer hardware. At 404, a light from the provided computer hardware is transmitted through the jumper in response to the jumper forming a circuit with the provided computer hardware.

In one implementation, the light is transmitted from a connecting face of the jumper to a light-emitting face of the jumper through a light pipe substantially within (e.g., more than 50% within) the jumper. The connecting face of the jumper may be substantially perpendicular or substantially parallel to the light-emitting face of the jumper. Additionally, the light pipe may be substantially between a plurality of receptacles on the connecting face of the jumper.

The light from the provided computer hardware is transmitted through the jumper in response to the jumper being mounted on a particular set of pins on the provided computer hardware in one embodiment. In another embodiment, the light is transmitted through the jumper in response to the jumper being selected for identification.

Figure 5:
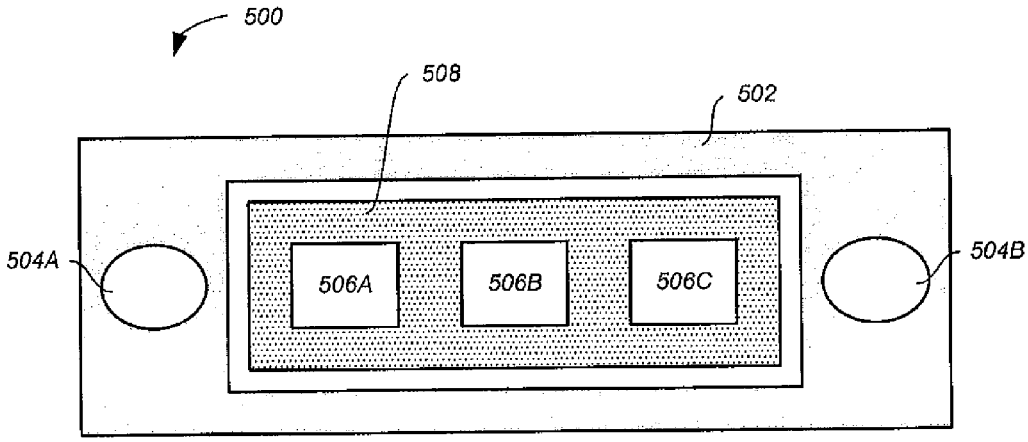
FIGS. 5-6 depict connecting face views of jumpers operable to configure computer hardware according to different embodiments of the invention.
Figure 6:
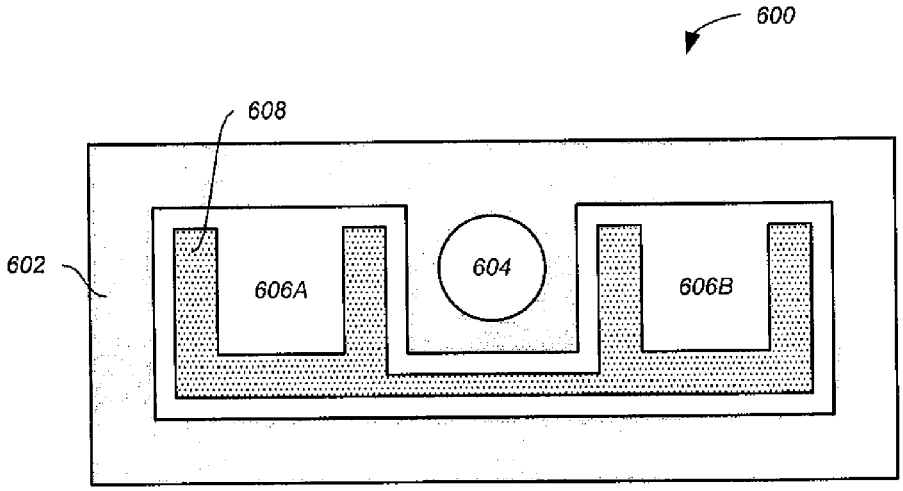

Depicted in FIGS. 5 and 6 are connecting face views of jumpers 500 and 600, which are operable to configure computer hardware, in accordance with various implementations of the invention. Jumper 500 includes a housing 502, which is composed of non-conductive material, such as plastic, two light pipes 504A and 504B substantially within housing 502, and three receptacles 506A-506C, which are formed and connected to one another by a metal 508.

In other embodiments, the number of receptacles and light pipes in jumper 500 may be increased or decreased. Additionally, one or both of light pipes 504A-504B may be external to housing 502. Further, the arrangement of receptacles 506A-506C and light pipes 504A-504B may be different. As an example, receptacles 506A-506C may be in a pyramid formation and light pipes 504A-504B may be located substantially below receptacles 506A-506C rather than substantially adjacent thereto. Moreover, the shape and size of light pipes 504A-504B and receptacles 506A-506C may be changed. For instance, each receptacle and light pipe may not necessarily be of the same shape and/or size as the other receptacle(s) and light pipe(s).

Jumper 600 comprises a housing 602, a light pipe 604 substantially within housing 602, and receptacles 606A and 606B. Receptacles 606A-606B in jumper 600, unlike receptacles 506A-506B, are not completely surrounded by a metal 608 that connects the two receptacles. As with jumper 500, many modifications may be made to jumper 600, such as adding more light pipes and/or receptacles, increasing or decreasing the sizes of light pipes and/or receptacles, changing the shapes of light pipes and/or receptacles, rearranging light pipe 604 and/or receptacles 606A-606B, etc.

Figure 7:
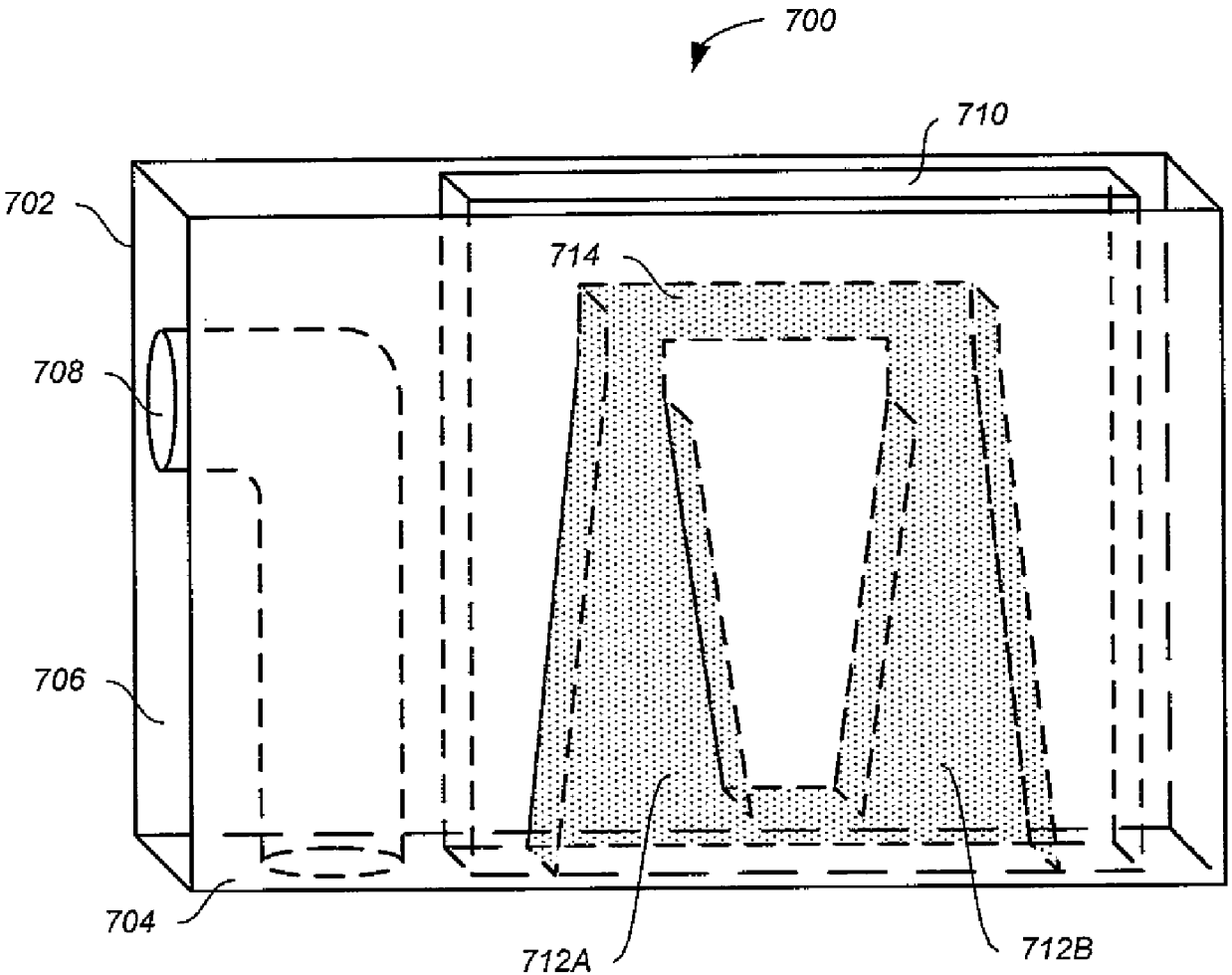
FIG. 7 illustrates a jumper operable to configure computer hardware in accordance with another implementation of the invention.

FIG. 7 illustrates a jumper 700 operable to configure computer hardware according to another embodiment of the invention. Jumper 700 includes a housing 702, a connecting face 704, and a light-emitting face 706. In this embodiment, light-emitting face 706 is substantially perpendicular to connecting face 704. Jumper 700 also includes a light pipe 708 that extends from connecting face 704 to light-emitting face 706. Since connecting face 704 is substantially perpendicular to light-emitting face 706, light pipe 708 is curved. In other embodiments, light pipe 708 may be of a different shape, such as slanted. Further, light pipe 708 may include one or more additional branches that extend to one or more other faces of jumper 700.

An opening 710 is also included in jumper 700, which extends from connecting face 704 to a face opposite connecting face 704. Within opening 710 are two receptacles 712A and 712B formed by a metal 714. Similar to jumpers 100, 200, 500, and 600, other implementations of jumper 700 may include additional receptacles and/or light pipes, different shapes and/or sizes for receptacles and/or light pipes, which may affect the size and shape of jumpers, alternative arrangements of receptacles and/or light pipes, etc.

Various implementations for jumper installation feedback have been described. Nevertheless, one of ordinary skill in the art will readily recognize that various modifications may be made to the implementations, and any variations would be within the spirit and scope of the present invention. For example, the number and layout of receptacles and light pipes in jumpers may be changed without affecting the scope or operation of the invention. Accordingly, many modifications may be made by one of ordinary skill in the art without departing from the spirit and scope of the following claims.

What is claimed is:

1. A method for fabricating a jumper operable to configure computer hardware, the method comprising:

forming a plurality of receptacles on a connecting face of the jumper; and incorporating a light pipe into the jumper, the light pipe extending from the connecting face of the jumper to a light-emitting face of the jumper.

2. The method of claim 1, wherein the connecting face of the jumper is substantially perpendicular to the light-emitting face of the jumper.

3. The method of claim 1, wherein incorporating the light pipe comprises:

incorporating the light pipe substantially between two of the plurality of receptacles.

4. The method of claim 1, wherein incorporating the light pipe comprises:

incorporating the light pipe substantially within a housing of the jumper, the housing being a non-conductive portion of the jumper.

5. The method of claim 1, wherein the light pipe is operable to transmit a light from a provided computer hardware from the connecting face of the jumper to the light-emitting face of the jumper in response to the jumper forming a circuit with the provided computer hardware.

6. The method of claim 1, wherein the plurality of receptacles is operable to interface with a plurality of pins on a provided computer hardware and the light pipe is operable to transmit a light from the provided computer hardware from the connecting face of the jumper to the light emitting face of the jumper in response to the plurality of receptacles interfacing with a particular subset of the plurality of pins on the provided computer hardware.

7. The method of claim 1, wherein the light pipe is operable to transmit a light from a provided computer hardware from the connecting face of the jumper to the light-emitting face of the jumper in response to the jumper being selected for identification.

8. A method for providing jumper installation feedback, the method comprising:

mounting a jumper on a provided computer hardware; and transmitting a light from the provided computer hardware through the jumper in response to the jumper forming a circuit with the provided computer hardware.

9. The method of claim 8, wherein the light is transmitted from a connecting face of the jumper to a light-emitting face of the jumper through a light pipe substantially within the jumper.

10. The method of claim 9, wherein the connecting face of the jumper is substantially perpendicular to the light-emitting face of the jumper.

11. The method of claim 9, wherein the light pipe is substantially between a plurality of receptacles on the connecting face of the jumper.

12. The method of claim 8, wherein the light from the provided computer hardware is transmitted through the jumper in response to the jumper being mounted on a particular set of pins on the provided computer hardware.

13. The method of claim 8, wherein the light from the provided computer hardware is transmitted through the jumper in response to the jumper being selected for identification.

* * * * *